US012365432B2

(12) United States Patent
Taylor et al.

(10) Patent No.: US 12,365,432 B2
(45) Date of Patent: Jul. 22, 2025

(54) VECTOR CONTROL ASSEMBLIES FOR UNDERWATER VEHICLES

(71) Applicant: Tiburon Subsea Inc., New York, NY (US)

(72) Inventors: Timothy Taylor, New York, NY (US); Robert Havens, Branford, FL (US)

(73) Assignee: Tiburon Subsea Inc., New York, NY (US)

( * ) Notice: Subject to any disclaimer, the term of this patent is extended or adjusted under 35 U.S.C. 154(b) by 502 days.

(21) Appl. No.: 17/933,371

(22) Filed: Sep. 19, 2022

(65) Prior Publication Data

US 2023/0090682 A1 Mar. 23, 2023

Related U.S. Application Data

(60) Provisional application No. 63/246,325, filed on Sep. 21, 2021.

(51) Int. Cl.
*B63G 8/20* (2006.01)
*B63G 8/08* (2006.01)

(52) U.S. Cl.
CPC ..... *B63G 8/20* (2013.01); *B63G 8/08* (2013.01)

(58) Field of Classification Search
CPC ... B63G 8/00; B63G 8/08; B63G 8/14; B63G 8/16; B63G 8/20
USPC ..... 114/312, 313, 330, 337, 338
See application file for complete search history.

(56) References Cited

U.S. PATENT DOCUMENTS

| | | | |
|---|---|---|---|
| 2,963,543 | A | 12/1960 | Link |
| 3,492,965 | A | 2/1970 | Wayfield |
| 6,427,618 | B1 | 8/2002 | Hilleman |
| 6,581,537 | B2 | 6/2003 | McBride et al. |
| 7,124,698 | B1 | 10/2006 | Shen et al. |
| 9,174,713 | B2 | 11/2015 | Item et al. |
| 9,919,792 | B2 * | 3/2018 | Zondervan ..... B64C 17/00 |
| 2003/0167998 | A1 | 9/2003 | Huntsman |
| 2012/0013795 | A1 | 6/2012 | Porfiri et al. |
| 2015/0027125 | A1 | 1/2015 | Raj |
| 2019/0009871 | A1 | 1/2019 | Borel et al. |

FOREIGN PATENT DOCUMENTS

| | | | |
|---|---|---|---|
| FR | 2243863 | A1 | 4/1975 |
| JP | 2015-534924 | A | 12/2015 |
| JP | 2017-206058 | A | 11/2017 |

(Continued)

OTHER PUBLICATIONS

Maki, Atsuo, Tatsuhiro Tsutsumoto, and Yoshiki Miyauchi. "Fundamental research on the maneuverability of the underwater vehicle having thrust vectoring system." Journal of Marine Science and Technology 23.3 (Published Dec. 14, 2017): 495-506.

(Continued)

*Primary Examiner* — Daniel V Venne
(74) *Attorney, Agent, or Firm* — Hinckley, Allen & Snyder, LLP; David Josephs

(57) ABSTRACT

A submersible vehicle is provided which is able to achieve six of freedom utilizing a combination of only two thrusters with no external control planes. Each of the two thrusters can include a plurality of ducts which can be selectively opened or closed, to varying degrees, to achieve six degrees of freedom for both control and propulsion.

17 Claims, 10 Drawing Sheets

(56) References Cited

FOREIGN PATENT DOCUMENTS

| | | | |
|---|---|---|---|
| JP | 2021-062851 | A | 4/2021 |
| WO | 2017109148 | A1 | 6/2017 |

OTHER PUBLICATIONS

Cavallo, Emanuele, Rinaldo C. Michelini, and Vladimir F. Filaretov. "Conceptual design of an AUV equipped with a three degrees of freedom vectored thruster." Journal of Intelligent and Robotic Systems 39.4 (2004):365-391.

* cited by examiner

VECTOR CONTROL ASSEMBLIES FOR UNDERWATER VEHICLES

CROSS REFERENCE TO RELATED APPLICATION

This application is related to and claims priority from earlier filed U.S. Provisional Patent Application No. 63/246,325, filed Sep. 21, 2021, the entire contents of the foregoing is incorporated herein by reference.

FIELD OF THE DISCLOSURE

The disclosure relates generally to a directions control system for submersible vehicles such as Remotely Operated Vehicles (ROV) or Autonomous Underwater Vehicles (AUV) that may be operated by umbilical tether, radio control, optical control or acoustical control. More specifically, the disclosure relates to a control system for submersible vehicles that can achieve six degrees of freedom in positional and motion control by employing two thrusters with no need for external control planes. The instant disclosure can achieve the aforementioned functionality while improving vehicle inherent stability and other desirable vehicle control abilities.

BACKGROUND OF DISCLOSURE

The current designs for submersible vehicles, such as autonomous underwater vehicles (AUV) and remotely operated vehicles (ROV), are propelled through the water column using a single thruster assembly. The thruster assembly usually consists of any one of various types of electric or fuel motor that provide power to a drive shaft that, in turn rotates a propeller mounted thereto. There are various types of shrouds, ducts or exposed propeller assemblies that direct the thrust generated by the propellor along the fixed earth coordinate system X-axis to provide forward or reverse movement. Directional control of these vehicles is typically achieved using three, or more, exposed external control surfaces. These exposed external control surfaces or "control planes" operate independently, or in concert with each other. The movement of the planes causes water resistance against the movement of the vehicle body in the water column, thereby forcing the vehicle to change direction giving the vehicle three degrees of freedom via yaw (vehicle moves left or right on the X axis), pitch (vehicle moves up or down on the Y axis), and roll (vehicle rotation angle off centerline on the X axis), as shown in FIG. 1.

The presently used control systems for submersible vehicles suffer from many design flaws and disadvantages. For example, while various AUVs use this basic design method to control AUV movement and directional control in water, the design fails to address multiple environmental and desired position control issues that can arise during marine surveys.

In general, all submersible vehicles that are thrust from, and/or positionally controlled from, the aft section of the vehicle body are inherently unstable and require constant adjustments by the positional control system to keep them on a desired course. Further, any body shape other than a sphere generates a moment when the submersible vehicle is inclined in an inviscid flow. The d'Alembert's paradox predicts zero net force, but not necessarily a zero moment. This, so-called, Munk moment arises because of asymmetric location of the stagnation points, where pressure is highest on the front of the body (decelerating flow) and lowest on the back (accelerating flow). The Munk moment is always destabilizing, in the sense that it acts to turn the vehicle perpendicular to the flow. This effect can be countered by vehicle designs that utilize forward (bow) section control planes, forward thrusters that can apply thrust counter to the Munk Moment or a combination of these design elements. The longer the vehicle and the wider the cross section of the vehicle, the more pronounced the Munk Moment force against the vehicle, requiring the control system to exert increased effort to maintain desired position. To account for the Munk Moment force, some submersible vehicles utilize a combination of five or more thrusters and two sets of control planes to achieve six degrees of freedom control. The addition of forward (bow) section control planes can be used to minimize Monk Moment on the hull to help stabilize forward motion along the X axis.

Geo positional control of these submersible vehicle design types require a minimum forward or reverse movement (speed) along the vehicle's X axis to generate flow over the control planes in order for the vehicle to maintain the desired geo position along all three axis of control. Depending on multiple factors, such as the individual vehicle mass and shape in relation to the size and type of control planes, water resistance, ocean currents or other dynamic force that can affect the vehicle position such as surface waves, surface wind etc., the vehicle must maintain a certain minimum forward motion in order to maintain geo positional control. Once the vehicles forward motion falls below this minimum the vehicle will suffer loss of positional control and will drift off the desired course or position or suffer other unwanted movement such as loss of pitch, roll, yaw. Avoiding these loss of control conditions is critical for accurate geo positional control of the vehicle as well as being able to maintain vehicle stability to assure a stable platform for whatever data collecting sensors or instruments payloads are being utilized during the survey.

In addition, when a submersible vehicle of this design type encounters ocean currents along the X (surge), Y (sway), or Z (heave) axis, these vehicle designs are poorly suited to counter these forces to maintain geo positional control, such as when a submersible vehicle is transiting down current along the X axis, and the ocean current exceeds the vehicles minimum required forward motion to maintain directional control. If a vehicle's optimal forward programmed survey speed is 4 km per hour and the vehicle requires a minimum forward speed of 3 km per hour to maintain positional control, an ocean current of 2 km per hour would produce a vehicle speed over ground of 6 km per hour. The vehicle will try to slow down forward motion to maintain the programed survey speed of 4 km per hour over ground. As a result of the reduction in forward motion, the vehicle will be moving down current at 4 km per hour over ground but only moving 2 km per hour through the water column, resulting in the vehicle not having enough forward movement to achieve the minimum 3 km per hour through the water column to maintain positional control of the vehicle.

In another example, a submersible vehicle can be moving up current along the X axis. If the ocean current exceeds the vehicles maximum forward motion capabilities it will fail to maintain directional control. If the vehicles maximum forward survey speed is 4 km per hour, the minimum positional control speed is 3 km per hour and the ocean current is 2 km per hour, the vehicle will not be able to achieve minimum forward motion of 3 km per hour to meet survey speed and may lose the ability to maintain directional control.

Further still, if a submersible vehicle is moving along X axis at survey speed but encounters ocean currents along the Y axis and if the ocean current exceeds the vehicles ability to maintain heading positional control along the X axis; then, the vehicle can fail to maintain geo position along the X axis or cause the vehicle to excessively yaw into the current to maintain X axis position causing degradation of survey data, loss of movement efficiency or possibly loss of positional control.

Moreover, the current submersible vehicle designs are incapable of performing several desirable positional control maneuvers. Those desirable positional control maneuvers can include:

(1) Maintaining positional control along the X axis in both directions from 0 km per hour to maximum vehicle speed.

(2) Maintaining positional control along the Y axis in both directions from 0 km per hour to the maximum vehicle speed.

(3) Maintaining positional control along the Z axis in both from 0 km per hour to the maximum vehicle speed.

(4) Maintaining positional control along the Z axis in both directions from 0 km per hour to maximum vehicle speed at any desired degree of pitch.

The ability of subsea marine vehicles such as AUVs to maintain 0 km per hour in all three axis and maintaining any desired position in six degrees of freedom along the three axis of positional control in dynamic environment is typically referred to as "station keeping" or "Parking." Current submersible vehicles are not capable of station keeping positional control along all three axis with positional control of the vehicle in six degrees of freedom with designs utilizing any less than five thrusters to maintain position. Current designs of submersible vehicles utilizing five, or more, thrusters can include:

(1) An AUV utilizing twelve distinct thrusters to achieve six degrees of freedom positional control (2) An AUV utilizing eight thrusters and articulating vehicle body segments to achieve six degrees of freedom positional control;

(3) A hovering autonomous underwater vehicle (HAUV) utilizing five thrusters to achieve six degrees of freedom positional control; and (4) An AUV utilizing a combination of five thrusters and two sets of control planes to achieve six degrees of freedom control. The forward (bow) section control planes can be used to minimize Monk Moment on the hull to help stabilize forward motion along the X axis The foregoing attempts in the prior art fail to meet the needs of the industry. There exists significant industry demand, for a submersible vehicle propulsion and system that can achieve six degrees of freedom utilizing a combination of as few thrusters as possible to improve power efficiency, simplify control, and with no external control planes.

SUMMARY OF THE DISCLOSURE

The present disclosure preserves the advantages of prior art while proving an improved submersible vehicle propulsion and positional control system that can achieve six degrees of freedom positional control utilizing a combination of only two thrusters in conjunction with two thrust vectoring control assemblies, with no external control planes.

One objective of the present disclosure is to improve the inherent stability of a submersible vehicle by directly countering Munk moment via vehicle thrust and positional control on both the bow (forward section) and stern (after section) simultaneously.

Another objective of the present disclosure includes improving other desirable vehicle control abilities with better positional control of the bow section of the vehicle while transiting on the surface in all sea states, which provides for more stable vehicle control of the vehicle while on the surface. This also optimizes the vehicle position for visual location and communications with the vehicle while on the surface.

A further objective of the present disclosure includes providing for redundant positional control for vehicle self-rescue in case of failure of one of the thrusters or positional control assemblies as either the bow or stern thruster and positional control sections can control the vehicle independently of one another.

Yet another objective of the present disclosure can include reducing, or in some cases eliminating, protrusions that are typical on other submersible vehicle designs such as external control planes and exposed or partially exposed thruster assemblies or propellers to reduce drag, increase propulsion efficiency and reduce potential for the vehicle to become entangled in debris, structures, or marine organics or on these surfaces.

A still further objective of the present disclosure can include the elimination of external control planes and exposed or partially exposed thruster propellers to reduce the chances of damage to the vehicle during survey operations, launch and recovery from a support vessel, fixed platform or shore, or during routine vehicle handling.

Other objectives of the present disclosure will be discussed in detail throughout the present disclosure, figures, and claims.

BRIEF DESCRIPTION OF THE DRAWINGS

The novel features which are characteristic of the present disclosure are set forth in the appended claims. However, the disclosure's preferred embodiments, together with further objects and attendant advantages, will be best understood by reference to the following detailed description taken in connection with the accompanying drawings in which:

DETAILED DESCRIPTION OF DISCLOSURE

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal. While reference is made with respect to autonomous underwater vehicles, it will be appreciated to those skilled in the art that the present disclosure can be used in other underwater vehicles or aquatic vehicles generally. Moreover, while reference is made to water, it will be appreciated to those skilled in the art that the vehicles discussed herein may be used in other fluids.

Figure 1:
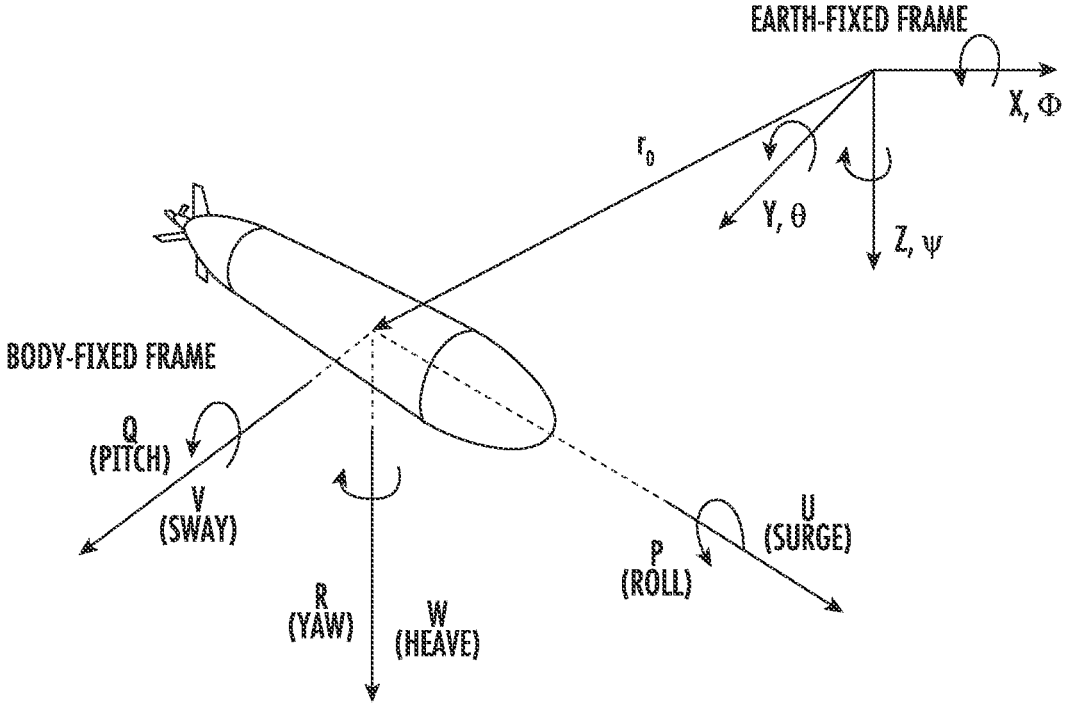
FIG. 1 shows a body-fixed frame and earth-fixed frame coordinate system.
Figure 2:
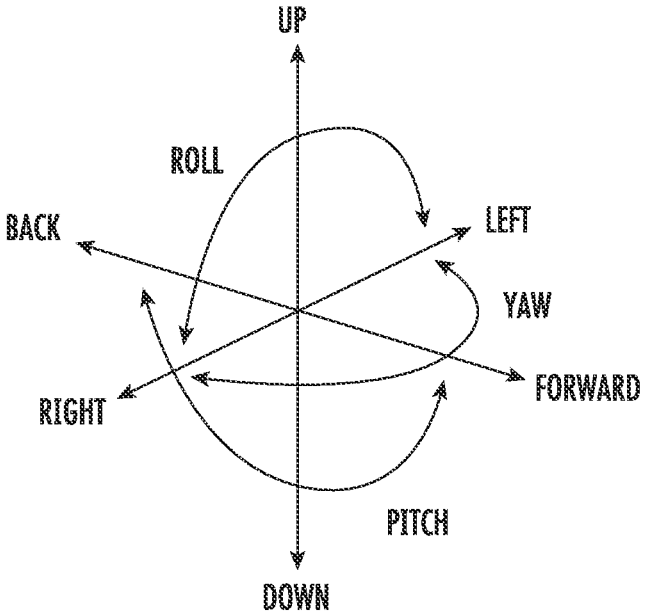
FIG. 2 shows six degrees of freedom of a fixed frame coordinate system.

The present disclosure is generally shown and illustrated in FIGS. 3-12, while its mode of operation is disclosed at FIGS. 13-18. The disclosure provides for a propulsion and directional control system for a submersible vehicle such as an autonomous underwater vehicle (AUV) or remotely operated vehicles (ROV) but is equally applicable to any submersible vehicle that operates in a fluid medium. Turning to FIGS. 1 and 2 coordinate reference frameworks are provided for illustration. In accordance with the present disclosure, the submersible vehicle is able to achieve six degrees of freedom meaning, controlled motion in a linear fashion along the x, y and z axis as well as rotation defined as pitch, yaw and roll, as shown in FIG. 2, utilizing a combination of only two thrusters with no externally mounted control planes.

Figure 3A:
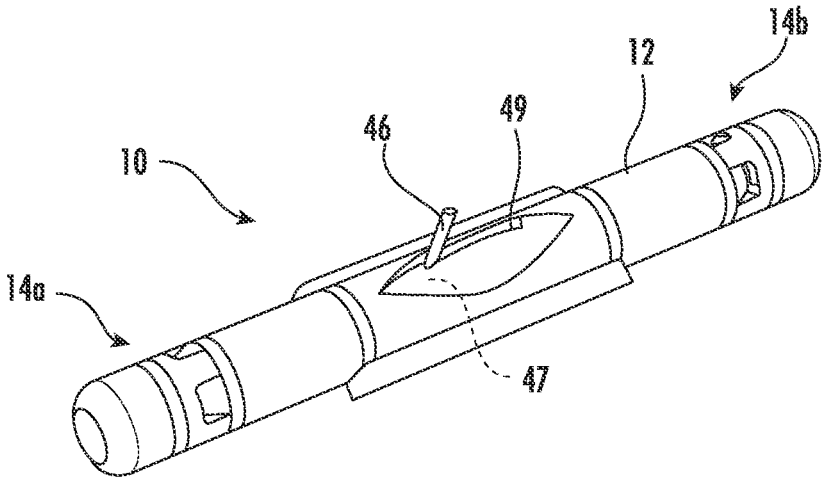
FIG. 3A shows a perspective view of a submersible vehicle employing the vector control assemblies of the present disclosure with antenna in an extended position.
Figure 3B:
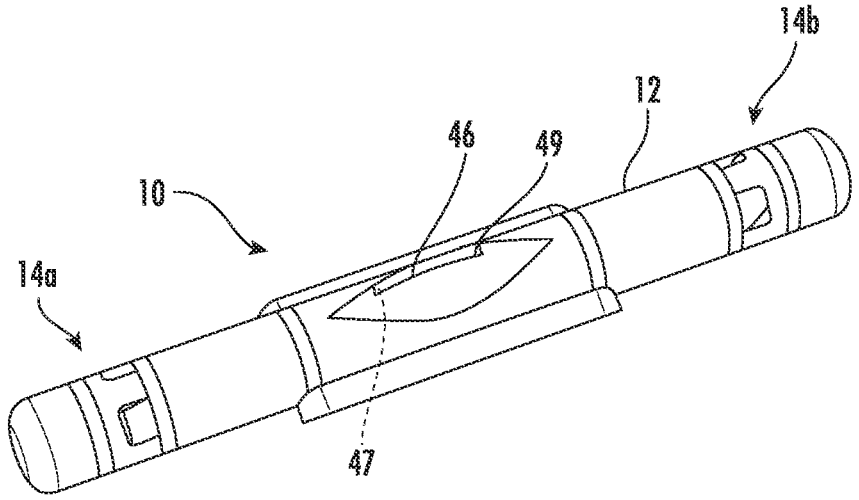
FIG. 3B shows a perspective view of a submersible vehicle employing the vector control assemblies of the present disclosure with antenna in an collapsed storage position.

In general, as shown in FIGS. 3A and 3B, the submersible vehicle 10 has a body 12 that can have a tubular, or capsule, shape. FIG. 3A shows an antenna mast 46 in and extended position while FIG. 3B shows the antenna mast 46 pivoted down to nest in seat 49. The submersible vehicle 10 includes one bow thruster 14*a* and one stern thruster 14*b* wherein the bow and stern thrusters are constructed and operate in the same manner as one another and are simply reversed for mounting onto the ends of the vehicle body. Accordingly, the remainder of the disclosure will describe in detail a thruster assembly 14 wherein thruster assembly equally applies to either a bow thruster 14*a* or a stern thruster 14*b*. In some embodiments, each section of the submersible vehicle can be 3D printed or additively manufactured. In other embodiments, each section can be manufactured using machining, casting, molding or any other known manufacturing techniques, or combinations thereof. Each of the bow and stern thrusters can have inlet and outlet portions, as will be discussed further below. The body 12 of the submersible vehicle 10 can accommodate a battery section and an electronics section. The battery section can accommodate a plurality of batteries which can power the bow thruster 14*a*, the stern thruster 14*b* and any electronics employed in the submersible vehicle 10. The electronics section can accommodate any number of sensors, cameras, communications modules, computing needs, and other required electronics to control the various systems on the submersible vehicle.

Figure 4:
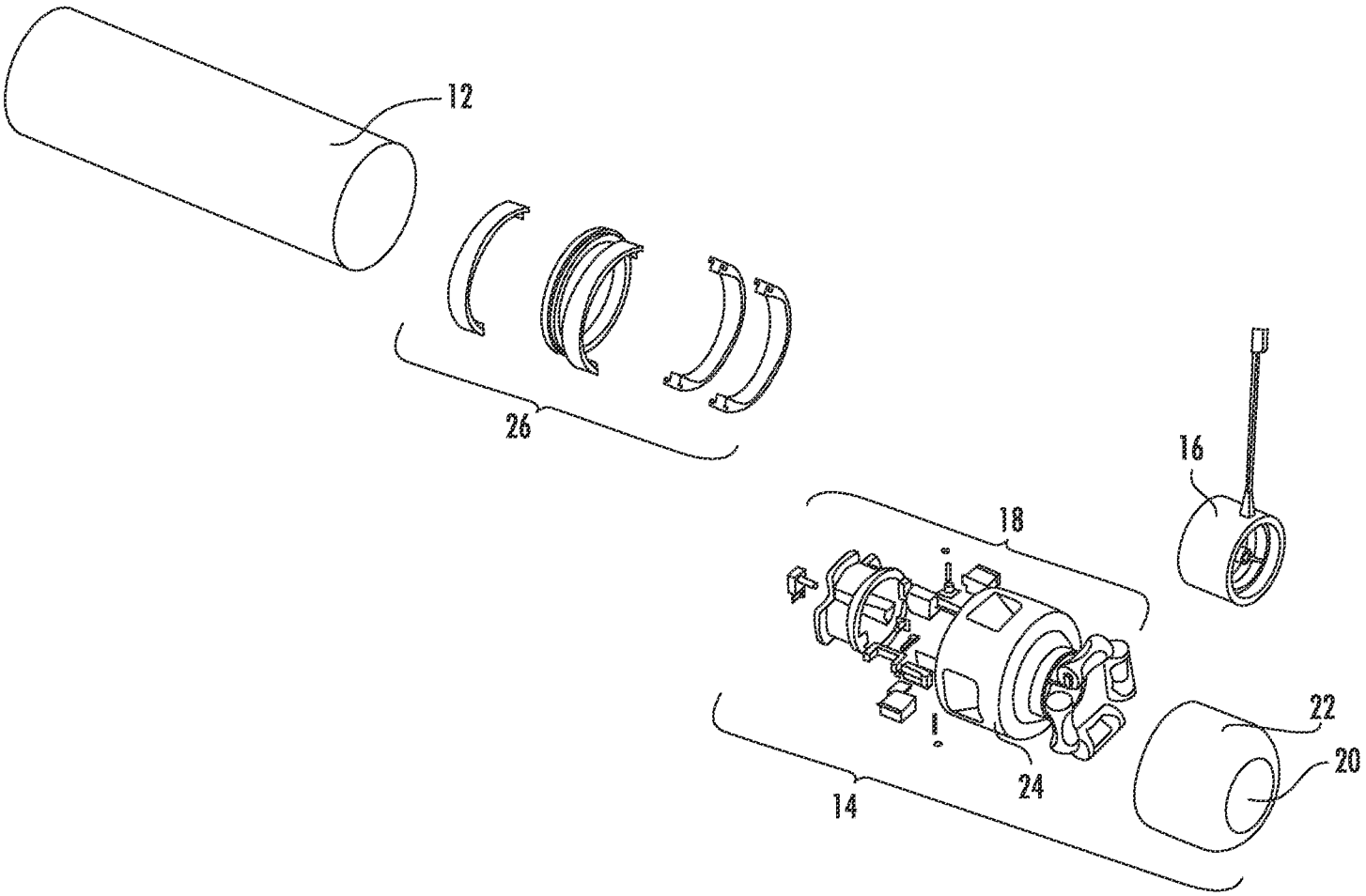
FIG. 4 shows an exploded view of the bow vector control assembly of the present disclosure (the stern vector control assembly being the same)

Turning now to FIG. 4 the submersible vehicle 10 is shown to include a body 12 and an exploded view of a thruster 14, wherein the flow thruster 16 and vectoring control assembly 18 are shown. The thrust vectoring control assembly can generally consist of a single axial flow thruster 16 situated centered axially on the X axis of the submersible vehicle. In the illustrated embodiment, one exemplary flow thruster 16 is shown as a rim thruster type design, but conventional shaft driven propeller thruster types could also be employed. The thruster 14 can take water in via the respective bow, or stern, through an inlet 20 in the shroud 22. The water is then directed into the vectoring control assembly 18 positioned within the vector control shroud 24 as will be described in detail below. Clamping rings 26 with gaskets provide for a rigid, waterproof interconnection between the body 12, the vector control shroud 24 which serves as an enclosure for the vectoring control assembly 18 and the shroud 22 which serves as the enclosure for the axial flow thruster 16.

Figure 5:
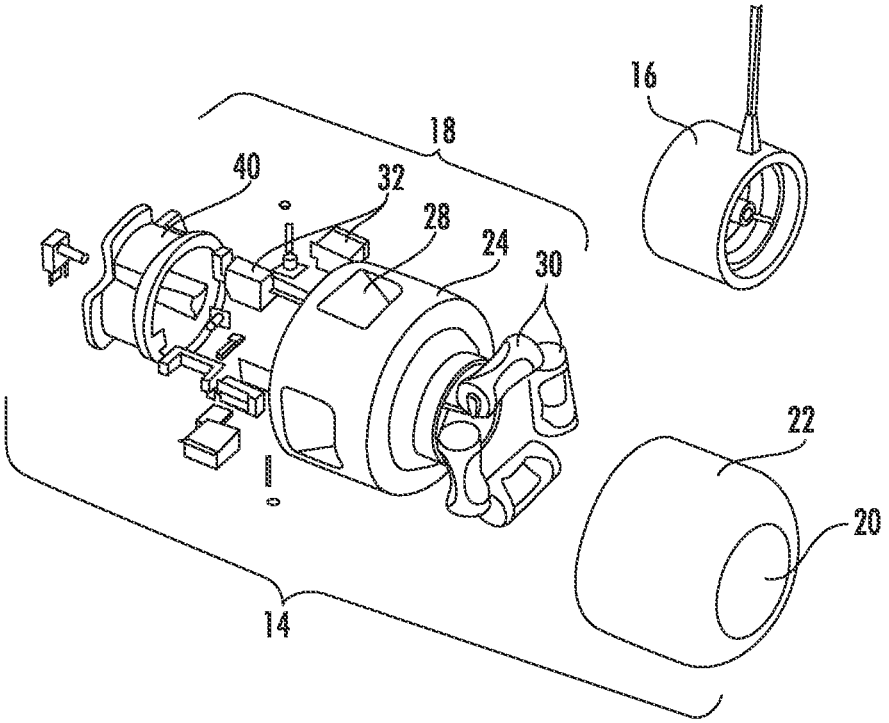
FIG. 5 is an exploded close-up view of the bow vector control assembly of the present disclosure (the stern vector control assembly being the same)

FIG. 5 provides an expanded view of the thruster 14. The axial flow thruster 16 is positioned within the shroud 22 such that it draws water in through the inlet 20 and directs it outwardly into the vector control shroud 24 where the water enters four separate flow ducts 28 axially spaced within the vector control shroud 24 such that they are circumferentially oriented at 45°, 135°, 225°, and 315°, about the x-axis. Each of the respective ducts 28 include a damper assembly 30 that can restrict and regulate the flow of water through its duct 28 independently from each other respective ducts. The damper assemblies 30 regulate the flow of water as it is discharged from the vector control shroud 24 wherein the relative angle of the flow discharge can be continuously altered by the damper assemblies 30 as between any angle from a longitudinal flow along the body 12 of the submersible vehicle, outwardly to a perpendicular flow relative to the body of the submersible vehicle. Servo motors 32 are employed and connected to each damper 30 via a linkage that allows the rotational angle of each damper 30 to be controlled independently of one another. In some embodiments, a cylindrical style damper can be used. In further embodiments, a blade style damper with a damper servo control, or a combination thereof can be used. In some alternative embodiments, the discharge duct angles, and radial orientations may vary, dependent on optimum efficiency derived by fluid model, full scale model testing or task specific desired performance. Importantly, in each of the discharge ducts, in the bow and the stern, include independently controlled dampers assemblies which can slow, or stop, the flow of a fluid through the respective duct.

Figure 6:
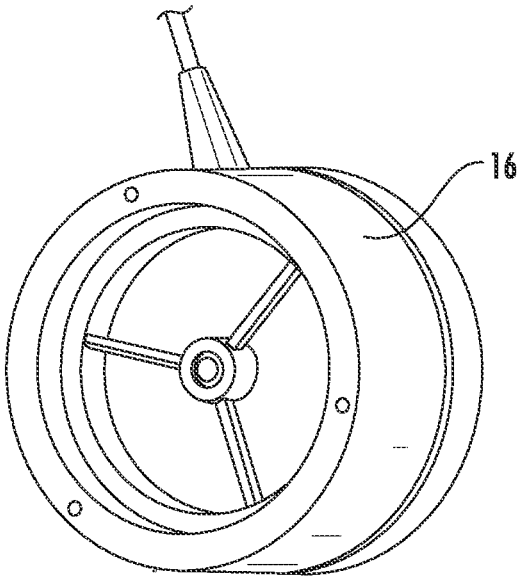
FIG. 6 is a perspective view of a thruster assembly.

At FIG. 6 one exemplary flow thruster 16 is shown as a rim thruster type design, but conventional shaft driven propeller thruster types could also be employed.

Figure 7:
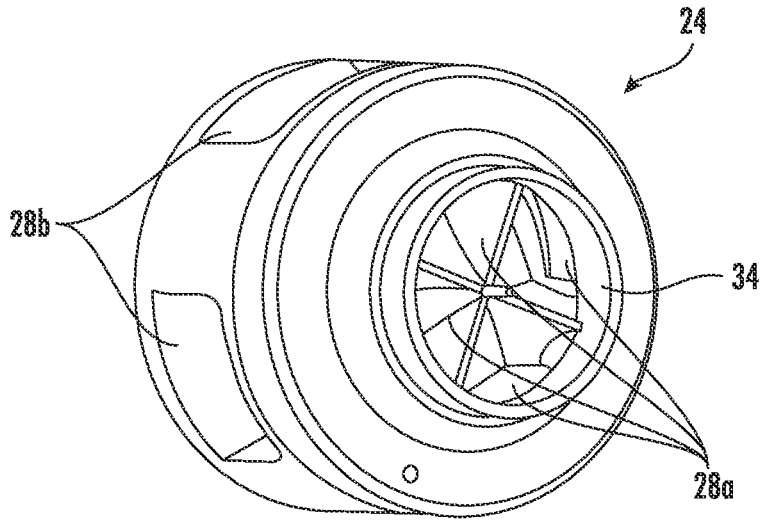
FIG. 7 is a front perspective view of a ducting housing in accordance with the present disclosure.
Figure 8:
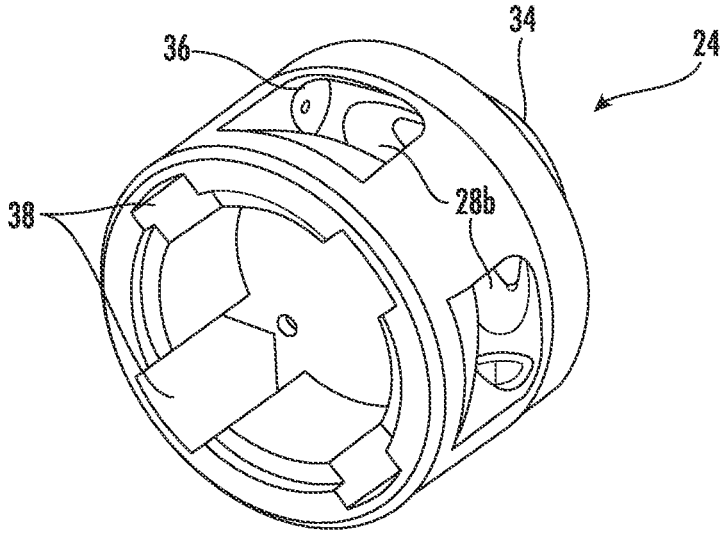
FIG. 8 is a rear perspective view of a ducting housing in accordance with the present disclosure.
Figure 9:
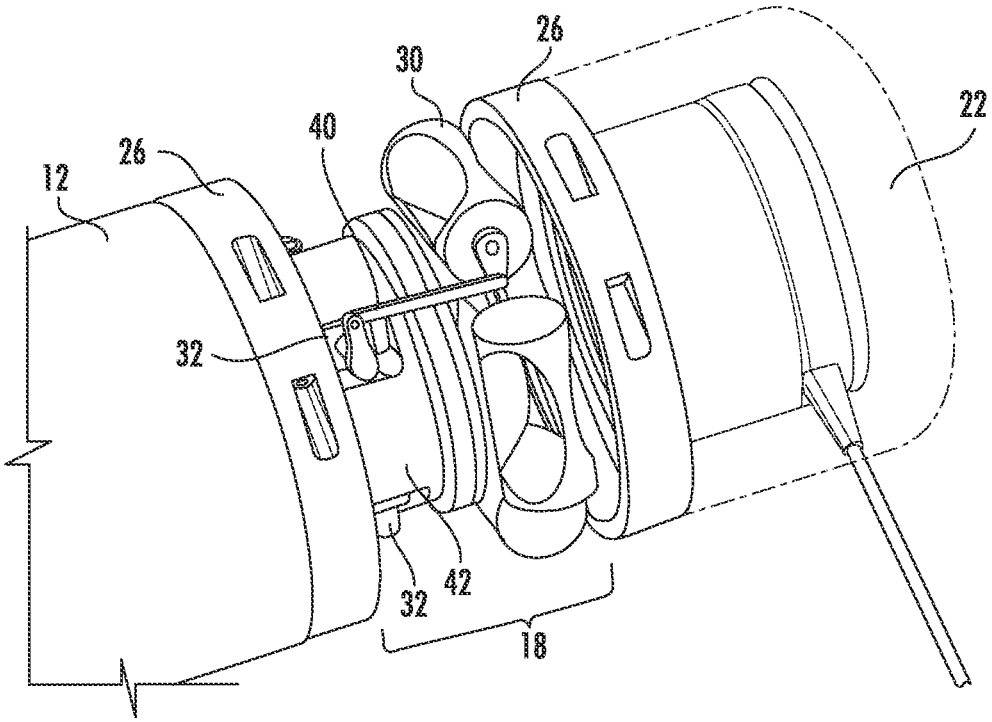
FIG. 9 is a side perspective view of the control valve assembly with the ducting housing removed of the present disclosure.
Figure 10:
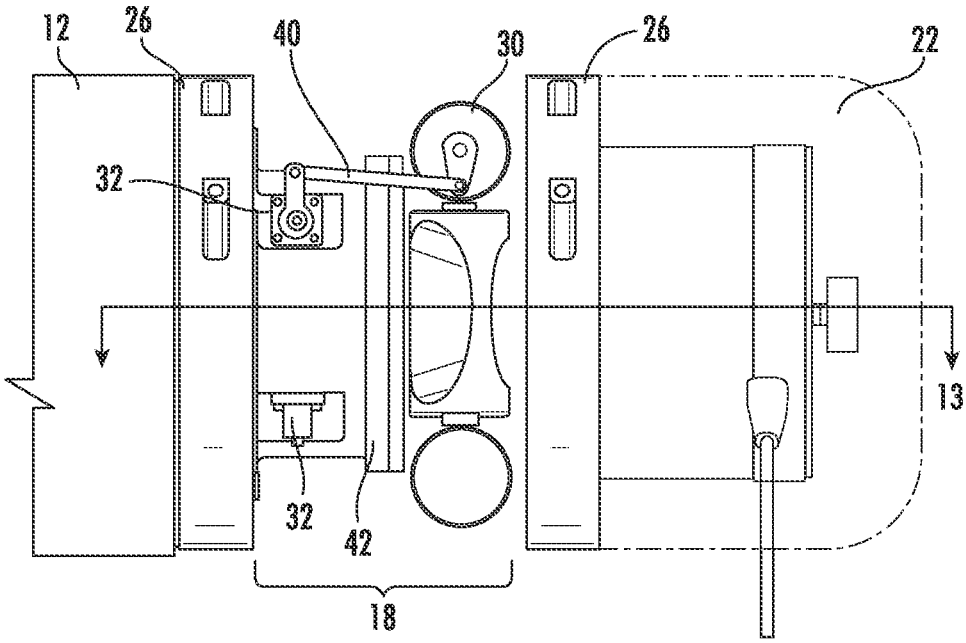
FIG. 10 is a side view of the control valve assembly with the ducting housing removed of the present disclosure.
Figure 11:
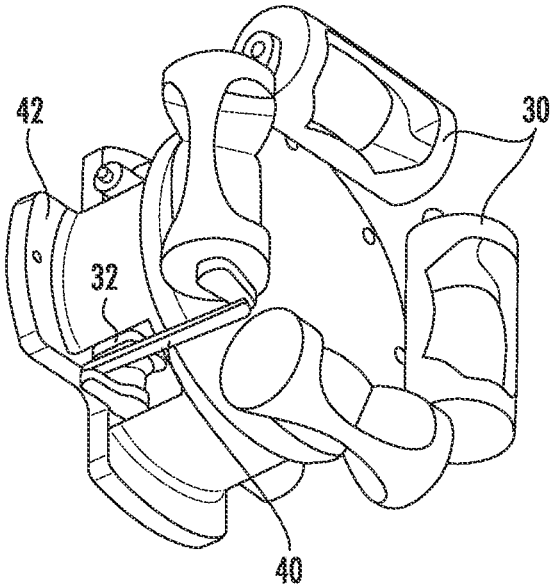
FIG. 11 is a perspective view of the control valve assembly of the present disclosure.
Figure 12:
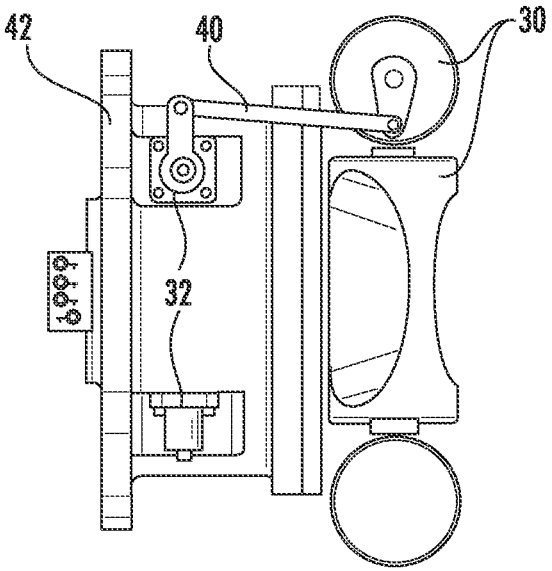
FIG. 12 is a side view of the control valve assembly of the present disclosure.
Figure 13:
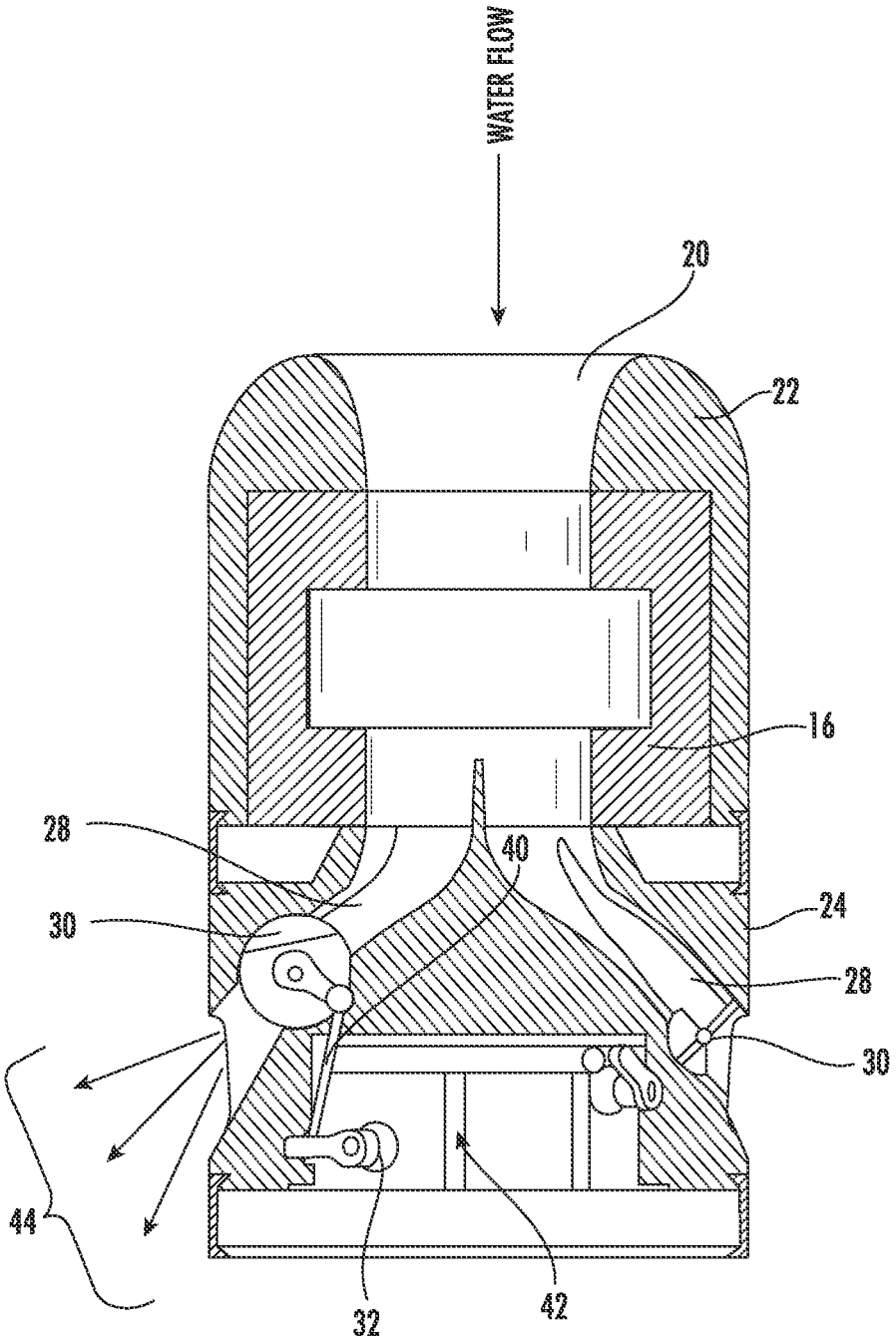
FIG. 13 is a cross sectional view of the thruster assembly of the present disclosure taken along line 13-13 of FIG. 10.
Figure 14:
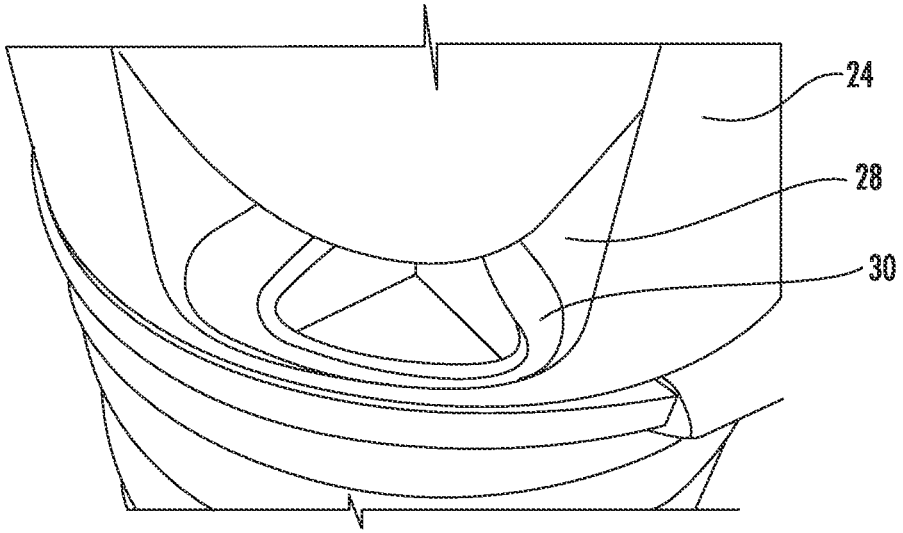
FIG. 14 is a view of a ducting channel with the control valve in a neutral position.
Figure 15:
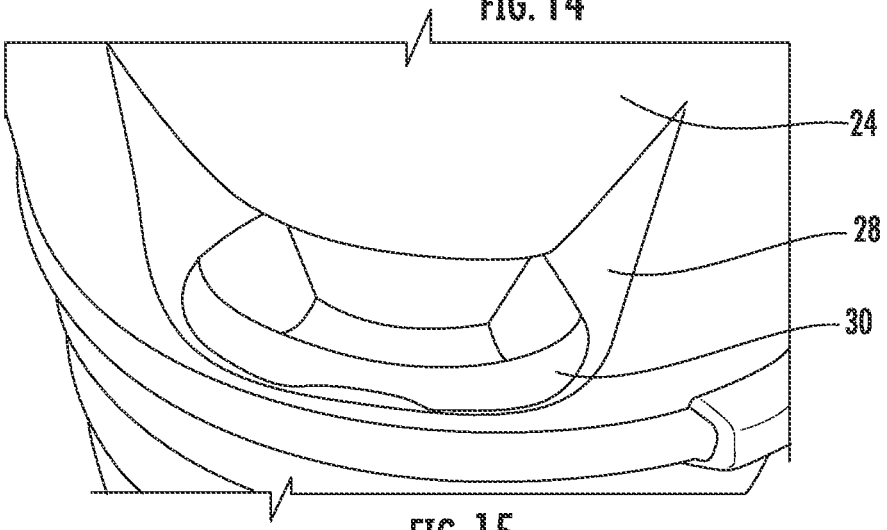
FIG. 15 is a view of a ducting channel with the control valve in a longitudinal thrust position.
Figure 16:
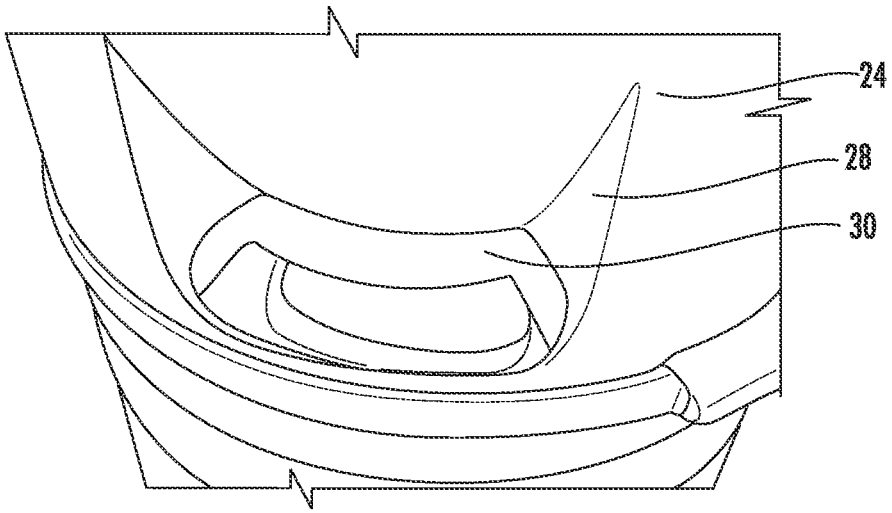
FIG. 16 is a view of a ducting channel with the control valve in a latitudinal thrust position.
Figure 17:
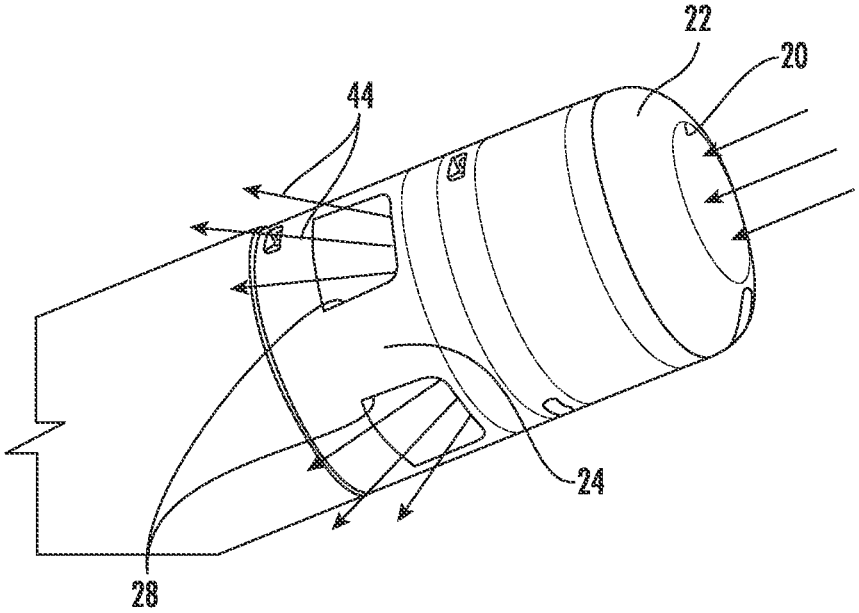
FIG. 17 shows a perspective view of water flow details of the thrusters of the present disclosure.
Figure 18:
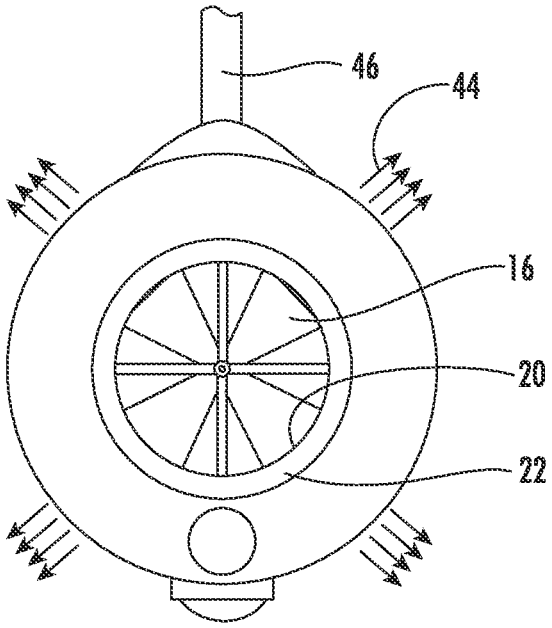
FIG. 18 shows an end view of water flow details of the thrusters of the present disclosure.

A detailed view of the vector control shroud 24 is provided at FIGS. 7 and 8. The vector control shroud 24 can be seen to include an inlet port 34 that is positioned behind the flow thruster 16 and receives and directs the flow of water therefrom. The flow at the inlet port 34 is directed into the inlet ends 28*a* of the flow ducts 28 and flows therethrough to respective outlet ends 28*b*. Valve seats 36 are provided within the flow ducts 28 to receive and retain a damper 30 therein. Recesses 38 can be seen as receiving positions for linkages from the servo motors 32 that control the rotational orientation of the dampers 30.

FIGS. 9-12 provide a detailed view of the vectoring control assembly 18 in its fully assembled position with the vector control shroud 24 removed for clarity. The thrust control dampers 30 are flow restriction/direction devices that partially restricts, redirects, and regulates the volume, velocity, and lateral direction of the flow of water through its respective flow duct 28. The control dampers 30 are rotationally positioned within the vector control shroud 24 each within a respective flow duct 28. Rotation of the control dampers 30 is accomplished via a mechanical linkage 40 that is engaged and controlled by the output shaft of a high torque servo motor 32 mounted to the electronic control module 42. The damper 30 operates as a type of valve and can be of cylindrical, blade or other types for different thrust/flow applications. The respective servo motors 32 are independently controlled via command from the vehicle's autonomous navigation computer and or directly remotely controlled by the submersible vehicle operator.

In the illustrated embodiment, as described above in FIGS. 3-12 with particular reference now to FIGS. 13-18, the submersible vehicle can include either a bow vector control assembly, a stern vector control assembly, or both. The bow vector assembly can include a front facing bow thruster inlet 22 in fluid communication with an axial flow thruster 16. Downstream of the axial flow thruster 16, the four outlet ducts 28 can be circumferentially arranged, as noted above. The outlet ducts 28 are generally directed axially downstream and radially outward to direct the flow of fluid. Each of the four outlet ducts 28 includes independently actuatable dampers 30 that can restrict and redirect flow 44 through its respective outlet duct 28. The fluid, or water, can enter the bow inlet as drawn in by the axial flow thruster and then selectively exit the outlet ducts, as they are open or closed. By adjusting each of the dampers independently, the flow can be varied in relative volume and direction continuously between a longitudinal and lateral flow such that imbalances as between flow from the four outlet ducts 28 can be adjusted to produce linear motion, lateral motion, and roll of the submersible vehicle. The bow vector control assembly can be used in connection with the stern vector control assembly at the rear of the submersible vehicle such that adjustment of the eight available dampers can then induce pitch and yaw as well. Further, adjustments to the dampers can cause the submersible vehicle to stand or hover at a station point as well in a stationary neutral buoyant position.

A mast 46 may be provided for remote communications with the submersible vehicle. The mast 46 may serve as a radio antenna or a connection point for an umbilical tether allowing electronic interconnectivity for control and data transfer between the submersible vehicle and the remote-control center. The mast 46 may be fixed or retractable to allow a reduction of turbulence when the submersible vehicle is operating below the water surface. For example, the mast/antenna 46 is preferably pivotally connected to the body 12 about a pivot point 47, as seen in FIGS. 3A and 3B discussed above. FIG. 3A shows the antenna mast 46 in and extended position while FIG. 3B shows the antenna mast 46 pivoted down to nest in seat 49.

Importantly, by regulating the flow of water, or the thrust, via the damper assembly the position of the vehicle can be controlled in all three fixed frame coordinates in one direction. Notably, each of the respective discharge ducts include a respective damper assembly. For example, the bow section positional direction and speed of vehicle can be controlled while moving forward if the two dampers on the upper side of the assembly (45° and 315° thruster outlets) are partially closed to reduce the flow and thrust, then the vehicle will pitch up. In a further example, if the two bow dampers on the underside of the assembly (135° and 225° thruster outlets) are partially closed to reduce the flow and thrust, then the vehicle will pitch down. Changes in the position of the respective dampers, with respect to the ducts, can affect both the volume and velocity of the water discharged from the respective duct thus affecting the amount of measurable thrust that duct produces. The relative orientation of the respective dampers, for example how far it is opened or closed, can increase or decrease thrusting force on the submersible vehicle affecting both positional direction and or speed through the water column.

In another example of use, if the two dampers on the port side of the assembly (45° and 135° thruster outlets) are partially closed to reducing the flow and thrust, then the vehicle will yaw to port. Similarly, if the two dampers on the starboard side of the assembly (225° and 315° thruster outlets) partially close reducing the flow and thrust the vehicle will yaw to starboard. In this example, the bow dampers can be partially closed while the stern dampers can be fully open if the stern thruster is providing thrust in the same direction as the bow. Alternatively, the bow dampers can be fully closed and not in use for this particular control maneuver.

The submersible vehicle can function in several modes. 1. Bow section only forward movement: in this mode the forward movement thrust along the X axis and positional control is only three axis of directional control, with the stern section not being utilized. 2. Bow section with stern section forward movement: in this mode the movement thrust along the X axis is produced by both the bow and stern sections (the stern section can take water into the control dampers in an open position and eject the water out of the assembly "intake" to provide thrust in the same direction along the X axis as the bow assembly) while the bow section provides three axis of directional control. 3. Bow and stern section six axis of control: In this mode, both bow and stern assemblies take in water from the thruster inlets and eject the water via the dampers allowing for the thrust to be used to hold the submersible vehicle in "Parking" position or move the submersible vehicle in any of the 6 axis of control. The bow and stern assemblies can thrust against each other to maintain desired position, if the bow section reduces thrust via reducing volume of water from the thruster motor (reduce motor rpm) without changing bow damper positions the submersible vehicle would move in the direction of the stern along the X axis as the stern section is now producing more thrust than the bow section etc. 4. Stern section reverse movement: In this mode, the stern section can provide thrust and three axis of directional control along the X axis in reverse submersible vehicle direction. This mode could be used for self-rescue if the bow section fails, the submersible vehicle gets stuck in an artifact or rock formation and need to reverse along the X axis, maneuver in reverse along the X axis on the surface during submersible vehicle recovery or to avoid collision etc.

Forward motion of the submersible vehicle along the X axis can be controlled via closing or opening all four dampers of the bow section synchronously while matching the proportion of each damper is open or closed. Additionally, forward motion can be controlled by varying water volume/velocity via changing thruster motor rotation rpm.

By installing two of the vector control assemblies on a submersible vehicle, one on the bow and one on the stern, disposed in opposing directions, as shown in FIGS. 3A and 3B, the stern assembly can thus control the vehicle position and movement in three axis of control and in one direction of movement. The two vector control assemblies, one in the bow and one in the stern, can act in concert to give the vehicle six degrees of freedom positional control. The vector control assemblies can be modular and swappable with other vector control assemblies with the understanding that if a bow assembly is used in place of a stern assembly, then the respective thruster propeller will have to be changed for one of the opposite pitch.

In addition, the direction of the flow of the water through the stern vector control assembly can be reversed making the thruster outlets the water inlet and the inlet the thruster outlet to give all positional control of the vehicle to the bow vector control assembly, while using the stern vector control assembly only for forward motion thrust giving the vehicle three axis control in one direction, as shown in FIGS. 3A and 3B. The same operation can be reversed from stern to bow allowing the vehicle to control positional and motion (forward speed) control in either direction with the same efficiency and positional control. By matching bow and stern thruster RPM the counter rotating rim thrusters will cancel out rotational torque on the vehicle along the X axis. A rim thruster can be defined as a motor/thruster combination assembly where the propeller is directly mounted to the rotating part of the motor assembly that does not use a conventional electric motor armature but utilizes a "rim" armature the propeller blades are affixed to.

The rim thruster designs have several advantages for marine use, as no watertight shaft seals are needed, they are crush proof and can work at any water depth, they produce more torque (force on the water) at lower RPMs than conventional shaft driven motors etc. As rim thrusters do not utilize a shaft armature/drive shaft assembly they are less likely to be fouled with debris such as fishing line and seaweed etc. As described above and shown in the figures, the rim thruster is shown being used to provide water propulsion for the vector control assembly. Other more conventional motor/propeller types could be used in conjunction with the damper assemblies, but the illustrated embodiment uses rim thruster for the advantages described above.

It would be appreciated by those skilled in the art that various changes and modifications can be made to the illustrated embodiments without departing from the spirit of the present disclosure. All such modifications and changes are intended to be covered by the appended claims.

What is claimed is:

1. A submersible vehicle, comprising:
- a body; and
  - at least one thruster assembly, positioned at one end of the body, the thruster assembly including:
    - an inlet;
    - a flow thruster; and
    - a vector control assembly, including:
      - a plurality of flow ducts directing a fluid flow from said flow thruster; and
      - an independently adjustable damper positioned within each of said plurality of flow ducts,
  - wherein independent adjustment of each of said adjustable dampers independently controls a volume and direction of flow through said plurality of flow ducts.

2. The submersible vehicle of claim 1, wherein the dampers are cylindrically shaped.

3. The submersible vehicle of claim 1, wherein the dampers are blade shaped.

4. The submersible vehicle of claim 1, wherein said flow thruster is a rim thruster.

5. The submersible vehicle of claim 1, wherein said flow thruster is a shaft driven propeller.

6. The submersible vehicle of claim 1, further comprising:
- a plurality of servo motors, each of said servo motors independently controllable and interconnected with one of said dampers via a linkage, wherein said servo motors each control a rotational position of each of said dampers.

7. The submersible vehicle of claim 1, wherein there are no external control planes.

8. The submersible vehicle of claim 1, wherein said at least one thruster assembly is two thruster assemblies, a forward thruster assembly at a first end of said body and a rear thruster assembly at a second, opposite end of said body.

9. The submersible vehicle of claim 8, wherein six degrees of positional control is achieved by operating only said forward and rear thruster assemblies in connection with one another.

10. A submersible vehicle, comprising:
- a body having a forward end and a rear end opposite said forward end;
  - a forward thruster assembly, positioned at said forward end of the body, the forward thruster assembly including:
    - an inlet;
    - a flow thruster; and
    - a vector control assembly, including:
      - a plurality of flow ducts directing a fluid flow from said flow thruster; and
      - an independently adjustable damper positioned within each of said plurality of flow ducts; and a rear thruster assembly, positioned at said rear end of the body, the rear thruster assembly including:

an inlet;

a flow thruster; and a vector control assembly, including:

a plurality of flow ducts directing a fluid flow from said flow thruster; and an independently adjustable damper positioned within each of said plurality of flow ducts, wherein independent adjustment of each of said adjustable dampers independently controls a volume and direction of flow through said plurality of flow ducts.

11. The submersible vehicle of claim 10, wherein the dampers are cylindrically shaped.

12. The submersible vehicle of claim 10, wherein the dampers are blade shaped.

13. The submersible vehicle of claim 10, wherein said flow thruster is a rim thruster.

14. The submersible vehicle of claim 10, wherein said flow thruster is a shaft driven propeller.

15. The submersible vehicle of claim 10, further comprising:

a plurality of servo motors, each of said servo motors independently controllable and interconnected with one of said dampers via a linkage, wherein said servo motors each control a rotational position of each of said dampers.

16. The submersible vehicle of claim 10, wherein there are no external control planes.

17. The submersible vehicle of claim 10, wherein six degrees of positional control is achieved by operating only said forward and rear thruster assemblies in connection with one another.

* * * * *